US009854341B2

(12) United States Patent
Chiang

(10) Patent No.: US 9,854,341 B2
(45) Date of Patent: Dec. 26, 2017

(54) MICROPHONE HEAD DEVICE

(71) Applicant: MASCOT ELECTRIC CO., LTD., Tainan (TW)

(72) Inventor: Albert Chiang, Tainan (TW)

(73) Assignee: Mascot Electric Co., Ltd., Tainan (TW)

( * ) Notice: Subject to any disclaimer, the term of this patent is extended or adjusted under 35 U.S.C. 154(b) by 0 days.

(21) Appl. No.: 15/237,027

(22) Filed: Aug. 15, 2016

(65) Prior Publication Data

US 2017/0264985 A1 Sep. 14, 2017

(30) Foreign Application Priority Data

Mar. 11, 2016 (TW) ..... 105107610 A

(51) Int. Cl.
*H04R 1/08* (2006.01)

(52) U.S. Cl.
CPC ..... *H04R 1/08* (2013.01); *H04R 1/083* (2013.01)

(58) Field of Classification Search
CPC ..... H04R 1/02; H04R 1/021; H04R 1/2876; H04R 1/2884; H04R 1/08; H04R 1/083
See application file for complete search history.

(56) References Cited

U.S. PATENT DOCUMENTS 5,054,079 A * 10/1991 Frielingsdorf ..... H04R 1/46 379/430
5,359,157 A * 10/1994 Liu ..... H04R 1/14 181/129
5,781,644 A * 7/1998 Chang ..... H04R 1/08 381/355
5,809,155 A * 9/1998 Su ..... H04R 19/04 381/174
6,682,043 B1 * 1/2004 Hsieh ..... H04R 1/083 248/618
2003/0197316 A1 * 10/2003 Baumhauer, Jr. ..... H04R 1/083 267/136

FOREIGN PATENT DOCUMENTS

WO WO 2011010391 A1 * 1/2011 ..... H04R 1/021

* cited by examiner

*Primary Examiner* — Matthew Eason
(74) *Attorney, Agent, or Firm* — Muncy, Geissler, Olds & Lowe, P.C.

(57) ABSTRACT

A microphone head device includes a microphone head, a mount and a vibration-absorbing unit. The mount includes amount ring surrounding the microphone head, and a plurality of annularly spaced-apart support rods projecting axially from the mount ring. The vibration-absorbing unit includes a surrounding body sleeved fittingly on the microphone head and having one end inserted between the microphone head and the mount ring, and a plurality of annularly spaced-apart hollow posts connected to the surrounding body and sleeved respectively on the hollow posts.

8 Claims, 5 Drawing Sheets

MICROPHONE HEAD DEVICE

CROSS-REFERENCE TO RELATED APPLICATION

This application claims priority to Taiwanese Patent Application No. 105107610, filed on Mar. 11, 2016.

FIELD

The disclosure relates to a microphone device, and more particularly to a microphone head device.

BACKGROUND

Referring to FIGS. 1 and 2, a conventional microphone head device includes a tubular connecting seat 11, a vibration-absorbing ring 12 disposed on a top end of the tubular connecting seat 11, a microphone head 13 surrounded by the vibration-absorbing ring 12, a fastener plate 14 disposed on a bottom end of the tubular connecting seat 11, and a fastener 15 directly securing the microphone head 13 to the tubular connecting seat 11 by extending through the fastener plate 14. The conventional microphone head device is threadedly fixed into a microphone housing 16 by two screws 18 securing the tubular connecting seat 11 to the microphone housing 16 and is covered by a microphone grille cap 17.

Since the vibration-absorbing ring 12 is made of a soft material, the vibration-absorbing ring 12 can prevent unnecessary vibrations from being transmitted to the microphone head 13. However, because the fastener 15 is made of a rigid material, vibrations can be easily transmitted from the fastener 15 to the microphone head 13, such that the microphone head 13 is inevitable to receive noises caused by the vibrations.

SUMMARY

Therefore, an object of the disclosure is to provide a microphone head device that can prevent the occurrence of unnecessary vibrations that can cause noises.

According to a first aspect of the disclosure, a microphone head device includes a microphone head, a mount and a first vibration-absorbing unit.

The mount includes a mount ring surrounding the microphone head and having an inner surrounding surface spaced apart from the microphone head, and a plurality of annularly spaced-apart first support rods projecting from the mount ring.

The first vibration-absorbing unit is made of a vibration-absorbing material, and includes a first surrounding body and a plurality of annularly spaced-apart first hollow posts.

The first surrounding body has a first inner tubular wall sleeved fittingly on the microphone head and having one end inserted between the microphone head and the mount ring, a first radial wall extending radially and outwardly from another end of the first tubular wall, which is located away from the mount ring, and a first outer tubular wall extending from the first radial wall toward the mount ring and surrounding the first inner tubular wall in a spaced apart manner.

The first hollow posts are connected to the first outer tubular wall and sleeved respectively on the first support rods.

According to a second aspect of the disclosure, a microphone head device includes a microphone head, a mount, a first vibration-absorbing unit, and a tubular connecting seat.

The mount includes a mount ring surrounding the microphone head and having an inner surrounding surface spaced apart from the microphone head, and a plurality of annularly spaced-apart first support rods projecting axially from the mount ring.

The first vibration-absorbing unit includes a first surrounding body sleeved fittingly on the microphone head and having one end inserted between the microphone head and the mount ring, and a plurality of annularly spaced-apart first hollow posts connected to a periphery of the first surrounding body and sleeved respectively on the first hollow posts.

The tubular connecting seat receives and supports the mount and the first vibration-absorbing unit.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
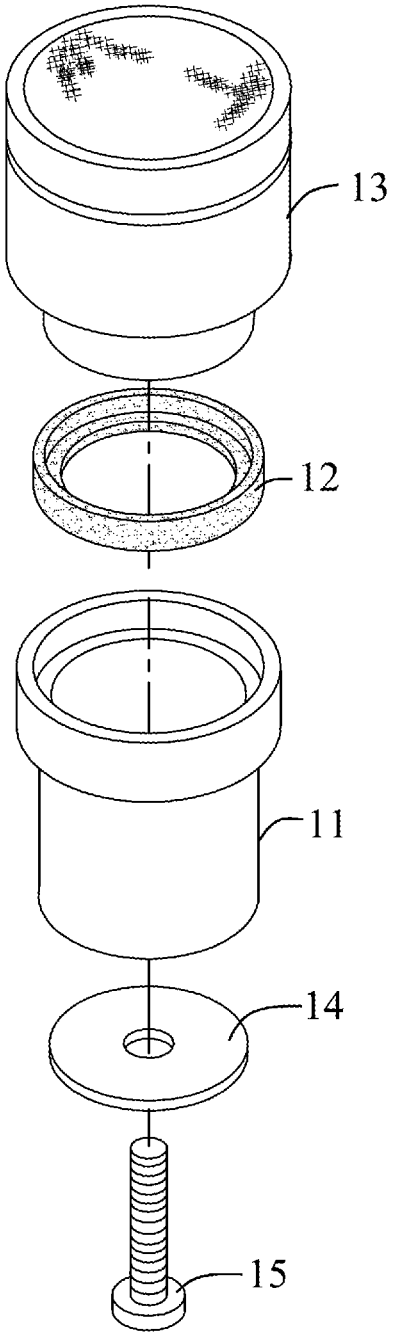
FIG.1 PRIOR ART
FIG. 1 is an exploded perspective view of a conventional microphone head device.
Figure 2:
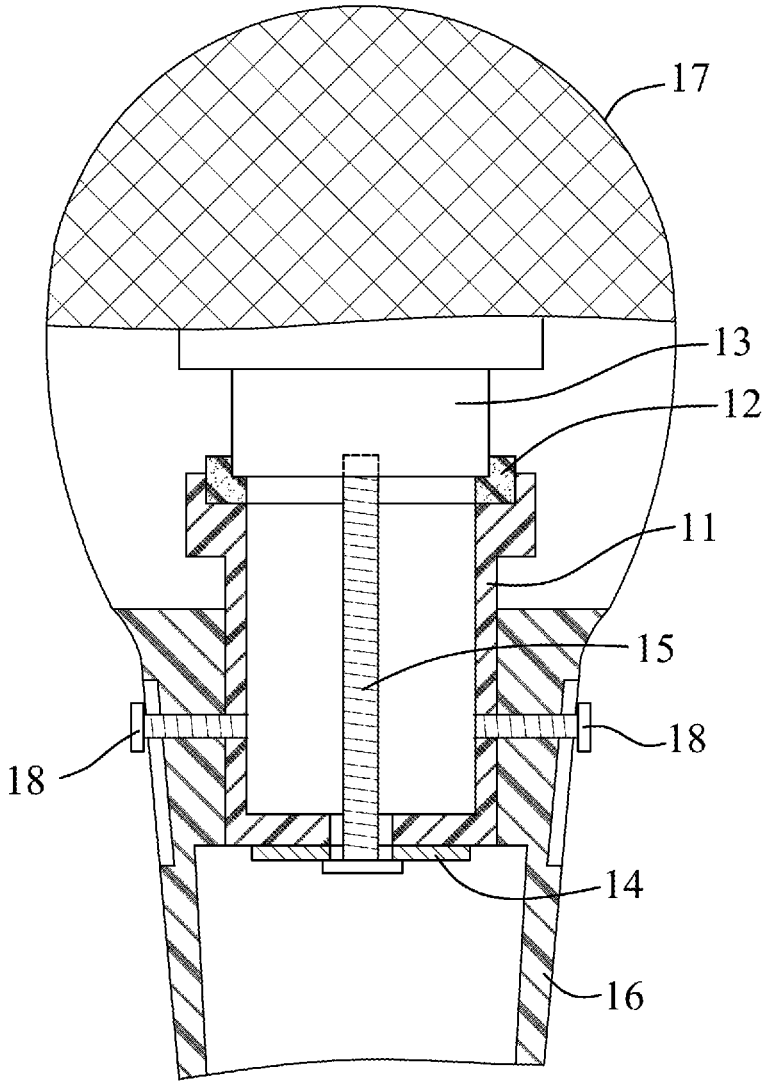
FIG.2 PRIOR ART
FIG. 2 is a fragmentary sectional view of the conventional microphone head device assembled to microphone housing and a microphone grille cap.
Figure 3:
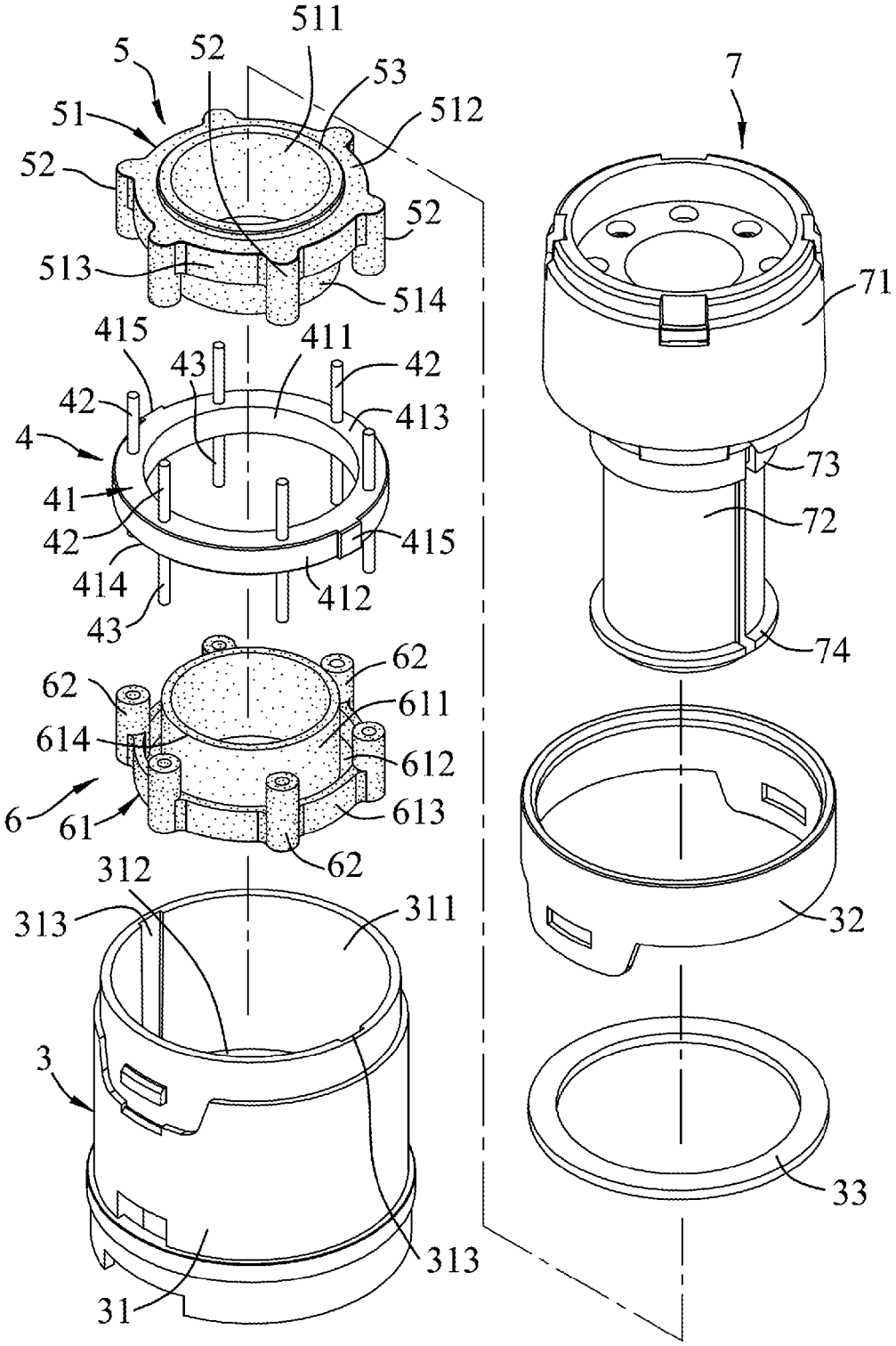
FIG. 3 is an exploded perspective view of a microphone head device according to an embodiment of the present disclosure.
Figure 4:
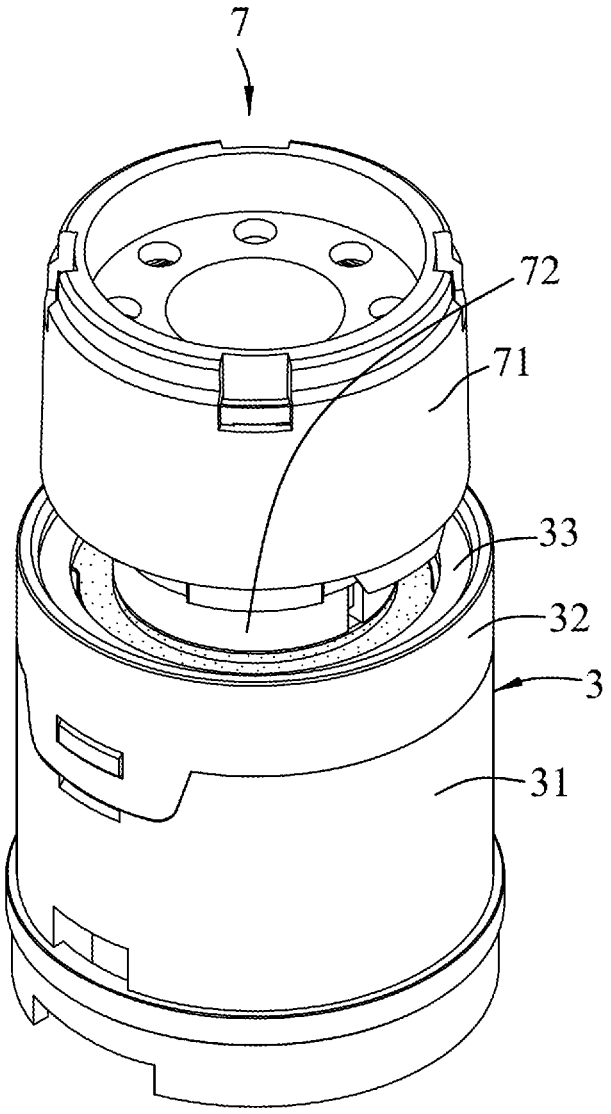
FIG. 4 is a perspective view of the embodiment, illustrating an assembly of the microphone head device.
Figure 5:
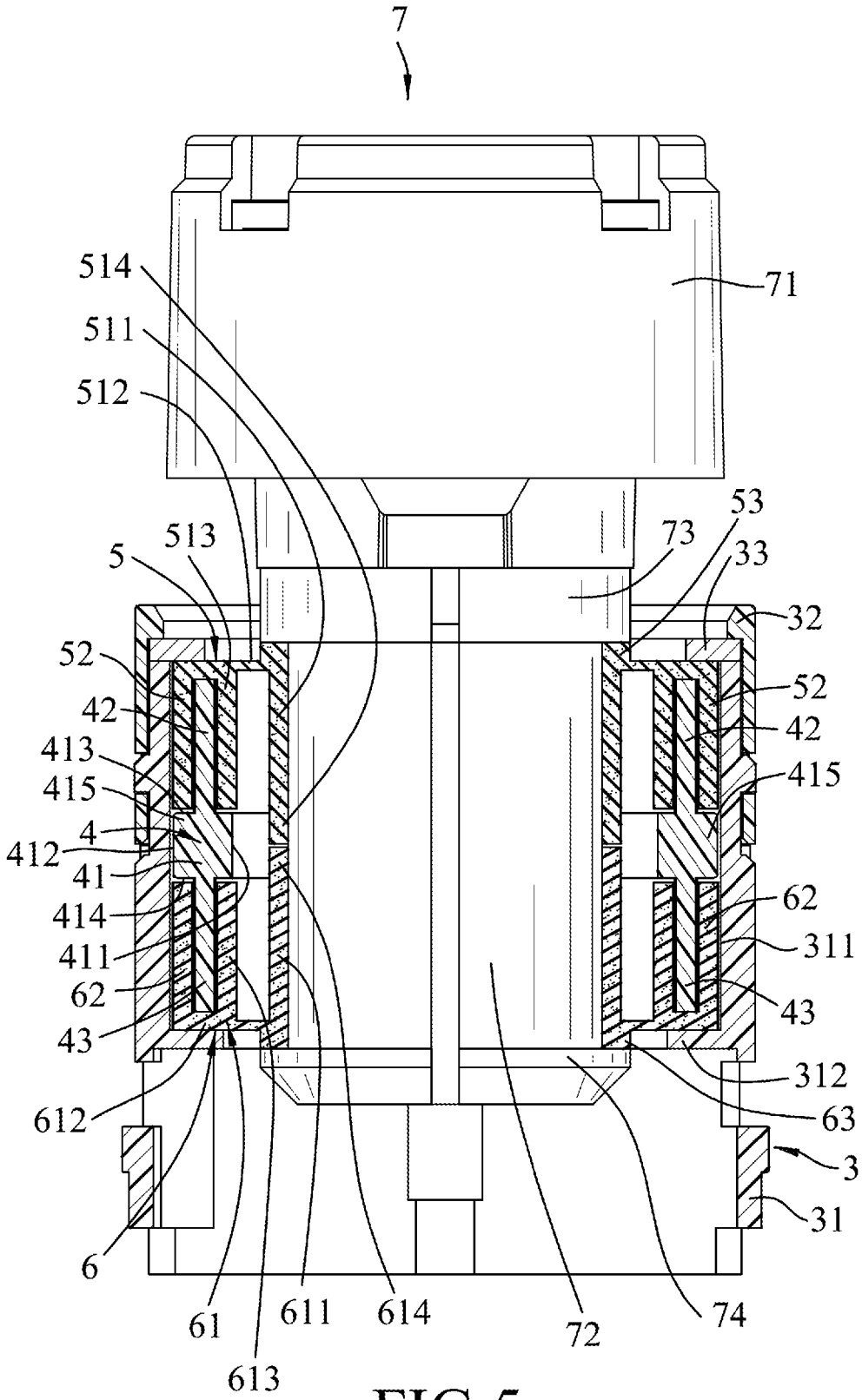
FIG. 5 is a partly sectional view of the embodiment.

Referring to FIGS. 3 to 5, a microphone head device according to an embodiment of the present disclosure is suitable for mounting on a microphone handle (not shown). The microphone head device includes a tubular connecting seat 3, a microphone head 7, a mount 4, a first vibration-absorbing unit 5 and a second vibration-absorbing unit 6.

The tubular connecting seat 3 is suitable for being disposed on the microphone handle. The tubular connecting seat 3 receives and supports the mount 4 and the first and second vibration-absorbing units 5 and 6, and includes a tubular body 31, a hollow cap 32 coaxially disposed on the tubular body 31, and a washer 33 disposed between the tubular body 31 and the hollow cap 32. The tubular body 31 has an inner surface 311, an annular flange 312 projecting radially inwardly from the inner surface 311 and located proximally to an end of the tubular body 31, and two annularly spaced-apart and axially extending grooves 313 indented from said inner surface 311. Each groove 313 extends axially from the annular flange 312 to another opposite end of the tubular body 31.

The microphone head 7 has a large-diameter cylindrical part 71, a small-diameter cylindrical part coaxial with and spaced apart axially from the large-diameter cylindrical part 71, a radially protruding first annular abutment portion 73 disposed between the large-diameter and small-diameter cylindrical parts 71, 72 and radially protruding from the small-diameter cylindrical part 72, and a radially protruding second annular abutment portion 74 coaxial with and radially protruding from the small-diameter cylindrical part 72. The second annular abutment portion 74 is axially spaced from the first annular abutment portion 73. The first annular abutment portion 73 is partly disposed in the tubular connecting seat 3. The small-diameter cylindrical part 72 and the second annular abutment portion 74 are located within the tubular connecting seat 3.

The mount 4 is received in the tubular connecting seat 3, and includes a mount ring 41, a plurality of annularly spaced-apart first support rods 42, and a plurality of annularly spaced-apart second support rods 43.

The mount ring 41 surrounds the small-diameter cylindrical part 72 of the microphone head 7, and has an inner surrounding surface 411 spaced apart from the small-diameter cylindrical part 72, an outer surrounding surface 412 radially opposite to the inner surrounding surface 411, a top surface 413 radially extending between the inner and outer surrounding surfaces 411, 412, a bottom surface 414 radially extending between the inner and outer surrounding surfaces 411, 412 and axially opposite to the top surface 413, and two radially projecting blocks 415 projecting outwardly from the outer surrounding surface 412 and radially opposite to each other. The projecting blocks 415 are respectively engaged with the grooves 313 to prevent the mounting ring 4 from rotating relative to the tubular connecting seat 3.

The annularly spaced-apart first support rods 42 project axially from the top surface 413 in parallel to the microphone head 7. The annularly spaced-apart second support rods 43 project axially from the bottom surface 414 in parallel to the microphone head 7 and in a direction opposite to the first support rods 42. The first support rods 42 are respectively aligned with the second support rods 43.

The first vibration-absorbing unit 5 is made of a vibration-absorbing material and is received in the tubular connecting seat 3. In this embodiment, the first vibration-absorbing unit 5 is made of a soft rubber material. Alternatively, the first vibration-absorbing unit 5 may be made of a soft plastic material. The first vibration-absorbing unit 5 includes a first surrounding body 51 and a plurality of annularly spaced-apart first hollow posts 52 connected to a periphery of the first surrounding body 51.

The first surrounding body 51 has a first inner tubular wall 511, a first radial wall 512 and a first outer tubular wall 513. The first inner tubular wall 511 is sleeved fittingly on the small-diameter cylindrical part 72 of the microphone head 7 and has one end (i.e., the lower end 514) inserted between the small-diameter cylindrical part 72 and the mount ring 41. The first radial wall 512 extends radially and outwardly from another end (i.e., the upper end) of the first inner tubular wall 511, which is located away from the mount ring 41 and opposite to the lower end 514 of the first inner tubular wall 511. The first outer tubular wall 513 extends from the first radial wall 512 toward the mount ring 41 and surrounds the first inner tubular wall 511 in a spaced apart manner. The first inner tubular wall 511 is longer than the first outer tubular wall 513. In addition, the first vibration-absorbing unit 5 further has a first abutment flange 53 that is disposed at a junction of the first inner tubular wall 511 and the first radial wall 512, and that is sleeved on the small-diameter cylindrical part 72 of the microphone head 7 to abut against the first annular abutment portion 73 of the microphone head 7.

The annularly spaced-apart first hollow posts 52 are connected to an outer periphery of the first outer tubular wall 513 and are sleeved respectively on the first support rods 42. In this embodiment, the inner surface 311 of the tubular connecting seat 3 surrounds the first hollow posts 52.

The second vibration-absorbing unit 6 is made of a vibration-absorbing material and is received in the tubular connecting seat 3. In this embodiment, the second vibration-absorbing unit 6 is made of a soft rubber material. Alternatively, the second vibration-absorbing unit 6 may be made of a soft plastic material. The second vibration-absorbing unit 6 including a second surrounding body 61 sleeved fittingly on the microphone head 7 at one side of the mounting ring 41 opposite to the first surrounding body 51, and a plurality of annularly spaced-apart second hollow posts 62 connected to a periphery of the second surrounding body 61.

The second surrounding body 61 has a second inner tubular wall 611, a second radial wall 612 and a second outer tubular wall 613. The second inner tubular wall 611 is sleeved fittingly on the small-diameter cylindrical part 72 of the microphone head 7 and has one end 614 inserted between the small-diameter cylindrical part 72 and the mount ring 41 in close proximity to the lower end 514 of the first inner tubular wall 511. The second radial wall 612 extends radially and outwardly from another end of the second tubular wall 611, which is located away from the mount ring 41 and opposite to the end 614 of the second inner tubular wall 611. The second outer tubular wall 613 extends from the second radial wall 612 toward the mount ring 41 and surrounds the second inner tubular wall 611 in a spaced apart manner. The second inner tubular wall 611 is longer than the second outer tubular wall 613. In addition, the second vibration-absorbing unit 6 further has a second abutment flange 63 that is disposed at a junction of the second inner tubular wall 611 and the second radial wall 612, and that is sleeved on the small-diameter cylindrical part 72 of the microphone head 7 to abut against the second annular abutment portion 74 of the microphone head 7.

The annularly spaced-apart second hollow posts 62 are connected to an outer periphery of the second outer tubular wall 613 and are sleeved respectively on the second support rods 43. The first hollow posts 52 are respectively aligned with the second hollow posts 62. In this embodiment, the inner surface 311 of the tubular connecting seat 3 surrounds the second hollow posts 62.

The first and second vibration-absorbing units 5 and 6 have multistage vibration-absorbing portions. Because the first hollow posts 52 are arranged in a spaced-apart fashion, they can easily make elastic deformation by extending into the gaps thereamong to absorb the vibration energy transmitted from the tubular connecting seat 3. Furthermore, because the first outer tubular wall 513 are spaced apart from the first inner tubular wall 511, it can easily make elastic deformation by extending into the gap therebetween to additionally absorb the vibration energy transmitted from the tubular connecting seat 3 through the first hollow posts 52. In this disclosure, the second vibration-absorbing unit 6 is substantially identical to the first vibration-absorbing unit 5 in structure, thereby performing the same function as the first vibration-absorbing unit 5. On the other hand, since the small-diameter cylindrical part 72 of the microphone head 7 is spaced apart from the mount 4 by the first and second inner tubular walls 511, 611 of the first and second vibration-absorbing units 5, 6, the vibration energy can be prevented from being directly transmitted to the microphone head 7. Moreover, because the microphone head 7 has no direct connection with other rigid components, the microphone head device of the present disclosure can prevent the occurrence of noises caused by vibrations transmitted through the rigid components.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A microphone head device comprising:

a microphone head;

a mount including a mount ring surrounding said microphone head and having an inner surrounding surface spaced apart from said microphone head, a plurality of annularly spaced-apart first support rods projecting from said mount ring, and a plurality of annularly spaced-apart second support rods projecting from said mount ring in a direction opposite to said first support rods;

a first vibration-absorbing unit made of a vibration-absorbing material, and including a first surrounding body having a first inner tubular wall sleeved fittingly on said microphone head and having one end inserted between said microphone head and said mount ring, a first radial wall extending radially and outwardly from another end of said first tubular wall, which is located away from said mount ring, and a first outer tubular wall extending from said first radial wall toward said mount ring and surrounding said first inner tubular wall in a spaced apart manner, and a plurality of annularly spaced-apart first hollow posts connected to said first outer tubular wall and sleeved respectively on said first support rods; and a second vibration-absorbing unit made of a vibration-absorbing material and including a second surrounding body sleeved fittingly on said microphone head at one side of said mounting ring opposite to said first surrounding body, and a plurality of annularly spaced-apart second hollow posts connected to a periphery of said second surrounding body and sleeved respectively on said second hollow posts.

2. The microphone head device as claimed in claim 1, wherein said second surrounding body has a second inner tubular wall sleeved fittingly on said microphone head and having one end inserted between said microphone head and said mount ring, a second radial wall extending radially and outwardly from another end of said second tubular wall located away from said mount ring, and a second outer tubular wall extending from said second radial wall toward said mount ring and surrounding said second inner tubular wall in a spaced apart manner, said second hollow posts connected to an outer periphery of said second outer tubular wall.

3. The microphone head device as claimed in claim 2, wherein said first hollow posts are respectively aligned with said second hollow posts.

4. The microphone head device as claimed in claim 2, wherein:

said first inner tubular wall is longer than said first outer tubular wall; and said second inner tubular wall is longer than said second outer tubular wall.

5. The microphone head device as claimed in claim 1, wherein said first and second vibration-absorbing units are made of a soft rubber material.

6. The microphone head device as claimed in claim 1, wherein:

said microphone head device further includes a tubular connecting seat receiving said mount and said first vibration-absorbing unit, said tubular connecting seat having an inner surface surrounding said first hollow posts, and a plurality annularly spaced-apart and axially extending grooves indented from said inner surface; and said mount ring has a plurality of radially projecting blocks respectively engaged with said extending grooves.

7. The microphone head device as claimed in claim 2, wherein:

said microphone head has a radially protruding first annular abutment portion and a radially protruding second annular abutment portion axially spaced apart from said first annular abutment portion;

said first vibration-absorbing unit further has a first abutment flange that is disposed at a junction of said first inner tubular wall and said first radial wall, and that is sleeved on said microphone head to abut against said first annular abutment portion; and said second vibration-absorbing unit further has a second abutment flange that is disposed at a junction of said second inner tubular wall and said second radial wall, and that is sleeved on said microphone head to abut against said second annular abutment portion.

8. A microphone head device comprising:

a microphone head;

a mount including a mount ring surrounding said microphone head and having an inner surrounding surface spaced apart from said microphone head, and a plurality of annularly spaced-apart first support rods projecting from said mount ring;

a first vibration-absorbing unit made of a vibration-absorbing material, and including a first surrounding body having a first inner tubular wall sleeved fittingly on said microphone head and having one end inserted between said microphone head and said mount ring, a first radial wall extending radially and outwardly from another end of said first tubular wall, which is located away from said mount ring, and a first outer tubular wall extending from said first radial wall toward said mount ring and surrounding said first inner tubular wall in a spaced apart manner, and a plurality of annularly spaced-apart first hollow posts connected to said first outer tubular wall and sleeved respectively on said first support rods; and a tubular connecting seat receiving said mount and said first vibration-absorbing unit, said tubular connecting seat having an inner surface surrounding said first hollow posts, and a plurality annularly spaced-apart and axially extending grooves indented from said inner surface;

wherein said mount ring has a plurality of radially projecting blocks respectively engaged with said extending grooves.

* * * * *